US008794349B2

(12) United States Patent
Heilig et al.

(10) Patent No.: US 8,794,349 B2
(45) Date of Patent: Aug. 5, 2014

(54) POWER-DRIVEN HAND-HELD TOOL

(75) Inventors: Mark Heilig, Winnenden (DE); Juergen Blickle, Goeppingen (DE)

(73) Assignee: C. & E. Fein GmbH (DE)

( * ) Notice: Subject to any disclaimer, the term of this patent is extended or adjusted under 35 U.S.C. 154(b) by 0 days.

(21) Appl. No.: 12/695,400

(22) Filed: Jan. 28, 2010

(65) Prior Publication Data

US 2010/0186980 A1 Jul. 29, 2010

(30) Foreign Application Priority Data

Jan. 29, 2009 (DE) ..... 20 2009 001 437 U

(51) Int. Cl.
*E21B 11/06* (2006.01)

(52) U.S. Cl.
USPC ..... 173/217; 173/216

(58) Field of Classification Search
USPC ..... 173/170, 171, 216, 217; D8/62; 451/353
See application file for complete search history.

(56) References Cited

U.S. PATENT DOCUMENTS

| | | | | | |
|---|---|---|---|---|---|
| 4,779,687 | A | * | 10/1988 | Schreiber et al. | 173/170 |
| 5,089,738 | A | * | 2/1992 | Bergqvist et al. | 310/50 |
| D386,378 | S | | 11/1997 | Henssler et al. | |
| 6,039,359 | A | * | 3/2000 | Valenziano | 285/45 |
| 6,139,359 | A | * | 10/2000 | Fuhreck et al. | 439/500 |
| D468,179 | S | * | 1/2003 | Hayakawa et al. | D8/62 |
| 6,742,601 | B2 | * | 6/2004 | Numata | 173/217 |
| D497,296 | S | * | 10/2004 | Krondorfer et al. | D8/62 |
| 6,935,438 | B2 | | 8/2005 | Hofmann et al. | |
| 7,111,364 | B2 | * | 9/2006 | Bader et al. | 16/436 |
| 7,121,362 | B2 | * | 10/2006 | Hsu et al. | 173/217 |
| 8,251,782 | B2 | * | 8/2012 | Riedl et al. | 451/359 |
| 2002/0134811 | A1 | | 9/2002 | Napier et al. | |
| 2004/0106036 | A1 | * | 6/2004 | Geis et al. | 429/99 |
| 2006/0191144 | A1 | * | 8/2006 | Suzuki et al. | 30/276 |
| 2007/0210744 | A1 | * | 9/2007 | Watson et al. | 320/112 |
| 2007/0214860 | A1 | * | 9/2007 | Frenken | 72/453.01 |
| 2007/0240892 | A1 | * | 10/2007 | Brotto et al. | 173/217 |

FOREIGN PATENT DOCUMENTS

| | | | |
|---|---|---|---|
| CN | 1343156 | A | 4/2002 |
| CN | 1388772 | A | 1/2003 |
| WO | 0214029 | A1 | 2/2002 |

* cited by examiner

*Primary Examiner* — Thanh Truong
*Assistant Examiner* — Nathaniel Chukwurah
(74) *Attorney, Agent, or Firm* — St. Onge Steward Johnston & Reens LLC

(57) ABSTRACT

A power-driven hand-held tool is disclosed. It comprises a housing, a drive motor arranged in the housing and having a motor shaft that defines a longitudinal axis, a workspindle comprising a tool holding fixture arranged outside the housing for holding a tool, wherein the workspindle defines a spindle axis arranged at an angle relative to the longitudinal axis, wherein at least one battery unit is provided for supplying the drive motor with energy, wherein the drive motor is coupled to the workspindle for driving same oscillatingly about the spindle axis, wherein a center of gravity of the battery unit is located on a side of the longitudinal axis opposite the tool holding fixture.

20 Claims, 1 Drawing Sheet

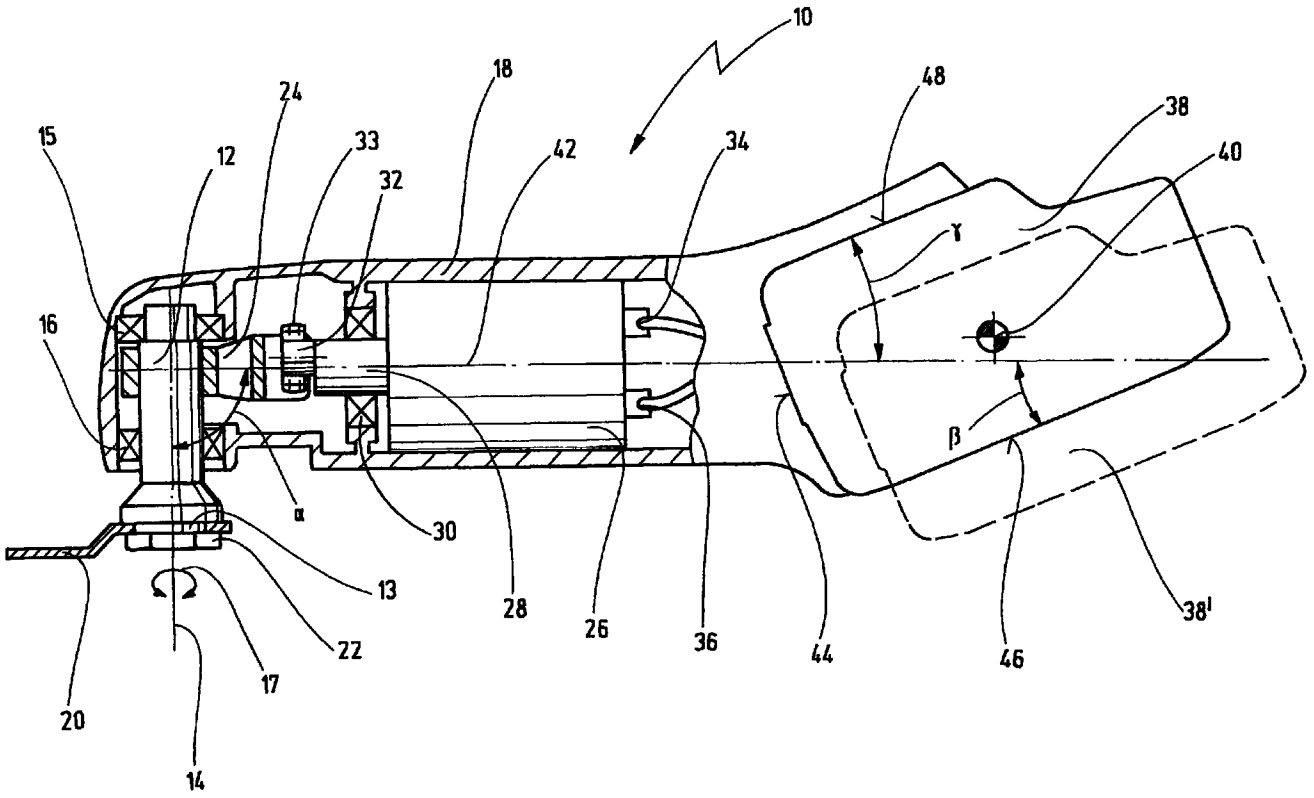
10
12
13
14
15
16
17
18
20
22
24
26
28
30
32
33
34
36
38
38'
40
42
44
46
48
α
β
γ

POWER-DRIVEN HAND-HELD TOOL

CROSSREFERENCES TO RELATED APPLICATIONS

This application claims priority of German utility model application 202009001437.1, filed on Jan. 29, 2009, the entire contents of which is incorporated herein by reference.

BACKGROUND OF THE INVENTION

The present invention relates to a power-driven hand-held tool having a housing, a drive motor arranged in the housing with a motor shaft that defines a longitudinal axis, a workspindle that serves to drive a tool that can be located on a tool holding fixture of the workspindle outside the housing, the workspindle oscillating about a spindle axis arranged at an angle relative to the longitudinal axis, and having at least one battery unit that serves to supply the drive motor with energy.

A hand-held tool of that kind is known from U.S. Design Pat. No. Des. 386,378. The described tool is a triangular grinder, which can be driven to oscillate, with a housing, a battery unit, a drive head and a workspindle that can be driven to oscillate for driving a tool located on the workspindle, the gear head, the housing and the battery unit being arranged along one longitudinal axis, and the spindle axis extending vertically to that longitudinal axis. The tool is located on the spindle axis outside the housing or the gear head.

Such oscillators can be used in diverse ways, for example for grinding or else for sawing or cutting. A usual range of oscillation frequencies is between approximately 5,000 to 25,000 oscillations per minute, a typical oscillation angle is between approximately 0.5° and 7°.

Hand-held tools of the before-mentioned kind provide a high degree of flexibility as regards their possible applications. The battery unit allows the hand-held tool to be supplied with energy even far away from all energy systems.

However, it has been found that vibrations may occur in such hand-held tools using a vibration drive, which may impair handling and long-term operation of the hand-held tool.

SUMMARY OF THE INVENTION

In view of this it is a first object of the invention to disclose a hand-held tool that offers easy and safe handling.

It is a second object of the invention to disclose a hand-held tool that allows a low vibration level.

According to the invention these and other objects of the invention are achieved by a hand-held tool according to the preamble of claim 1 wherein the battery unit has a center of gravity which is located on a side of the longitudinal axis opposite the tool holding fixture.

The object of the invention is thus perfectly achieved.

According to the invention, the workspindle, which can be driven to oscillate, and the tool that is located on the drive spindle outside the housing, are balanced by a counter-weight provided on the side of the longitudinal axis opposite the tool, in order to influence the frequency and amplitude of the oscillations encountered. The battery unit is used as a counter-weight for that purpose.

It is possible in this way to reduce the level of vibrations felt by the user, and also to reduce the level of sound emitted by the hand-held tool. Handling of the hand-held tool is simplified in this way.

It should be noted in that connection that the term "center of gravity" as used in the present application is meant to describe the center of a body related to gravity. It is stressed in this connection that for purposes of the invention the center of gravity conforms, with sufficient accuracy, with the center of mass.

According to a preferred embodiment of the invention, more than 50% of the battery unit, related to its volume, are arranged on the side of the longitudinal axis opposite the tool holding fixture.

This feature allows an arrangement where the center of gravity is located as a counter-weight on that side of the longitudinal axis that faces away from the tool holding fixture, even when the storage elements used show a homogeneous distribution of their weight.

According to an advantageous embodiment of the invention, the drive motor is arranged between the workspindle and the battery unit, viewed in the direction of the longitudinal axis.

It is possible in this way to make use of known configurations and arrangements of the workspindle and the drive motor. For handling, the hand-held tool can be held by the user in known gripping positions. This guarantees easy handling.

According to a convenient further development of the invention, the center of gravity of the battery unit is located in a plane defined by the spindle axis and the longitudinal axis.

This permits a symmetrical distribution of the mass to be obtained, related to the plane defined by the spindle axis and the longitudinal axis. A low vibration level may be further reduced in this way.

According to an advantageous further development of the invention the battery unit is exchangeable.

That feature increases the flexibility of the hand-held tool. Conveniently, the user may carry with him additional charged battery units in order to be able to exchange empty battery units after use.

According to an advantageous configuration of the invention, the battery unit is provided with an end face pointing toward the workspindle, and an adjacent outer surface that comprises an at least partially flat portion, which portion and the longitudinal axis enclose between them an angle of between 5° and 60°, preferably between 10° and 35°.

Thus, existing battery units, having a big volume related to the enclosed space, can be used for energy storage. Further, the center of gravity of the battery unit can be placed on the side of the longitudinal axis that faces away from the tool by giving the battery unit an arrangement that is inclined by the respective angle. This results in improved ergonomy.

According to a further embodiment of the invention, the battery unit is provided, opposite the outer surface, with a covering surface that comprises an at least partially flat portion, which portion and the longitudinal axis enclose between them an angle of between 5° and 60°, preferably between 10° and 35°.

As a result of that feature, the housing may have an inclined transition zone in the transition between the drive motor and the battery unit, on the side of the longitudinal axis opposite the tool holding fixture. It is thereby possible for the user to continue to use the known preferred gripping positions. Ergonomy is thus further improved.

It is understood that the features of the invention mentioned above and those yet to be explained below can be used not only in the respective combination indicated, but also in other combinations or in isolation, without leaving the scope of the invention.

BRIEF DESCRIPTION OF THE DRAWINGS

Further features and advantages of the invention will become apparent from the description that follows of a preferred embodiment, with reference to the drawing. In the drawing:

FIG. 1 shows a partially sectioned representation of one embodiment of a hand-held tool according to the invention with an oscillating drive.

DESCRIPTION OF PREFERRED EMBODIMENTS

FIG. 1 shows a partially sectioned representation of a power-driven hand-held tool according to the invention, indicated generally by reference numeral 10. The hand-held tool 10 comprises a housing 18 in which a drive motor 26 is arranged. The drive motor 26 comprises a motor shaft 28 that can be driven about a longitudinal axis 42. The motor shaft 28 is seated in the housing 18 via a motor bearing 30, illustrated diagrammatically in the drawing. The motor shaft 28 is provided with an eccentric journal 32 on its end. The eccentric journal 32 is designed as a shaft extension which is radially displaced relative to the longitudinal axis 42. The periphery of the eccentric journal 32 coacts with an eccentric bearing 33, schematically shown in the drawing as having a convex outer ring.

A workspindle 12 provided at the end of the housing 18 is seated in the housing 18 via a spindle bearing 15 in its upper area, and via a spindle bearing 16 in its lower area. A tool 20 is located in a tool holding fixture 13 in the lower area of the workspindle 12 via a securing element 22. The connection may be force-locking, force-locking and form-locking, or of any other kind suited for transmitting a torque.

The workspindle 12 can be driven to oscillate about a spindle axis 14, the respective oscillating angle is indicated by double arrow 17. As has been mentioned before, oscillation occurs at high frequency and by a low oscillating angle. A rocker arm 24 is connected with the workspindle 12 in a securely defined position. The rocker lever 24 serves as coupling element for transmitting the rotary movement of the motor shaft 28 to the workspindle 12. The spindle axis 14 is arranged vertically to the longitudinal axis 42, which is indicated by the angle $\alpha$. It is understood that the longitudinal axis 42 and the spindle axis 14 may also enclose between them an angle $\alpha$ different from 90°.

A battery unit 38 is detachably disposed on that end of the housing 18 which faces away from the spindle axis 12. The battery unit 38, for example an accumulator, supplies the drive motor 26 with energy. The drive motor 26 is provided for that purpose with two connections 34, 36. The supply unit 38 has a center of gravity 40 which is located on that side of the longitudinal axis 42 which faces away from the tool holding fixture 13. The battery unit 38 has an end face 44, pointing toward the drive motor 26 or the spindle axis 12, and comprises an outer surface 46 as well as a covering surface 48 that are arranged in parallel one to the other. The outer surface 46 and the longitudinal axis 42 enclose between them an angle $\beta$. The covering surface 48 and the longitudinal axis 42 enclose between them an angle $\gamma$. In the illustrated embodiment of a hand-held tool according to the invention, the angles $\beta$ and $\gamma$ are identical, although it is understood that the angles $\beta$ and $\gamma$ may also be different. The battery unit 38 is exchangeable, which is indicated schematically by a battery unit 38' that has been detached from the housing 18.

As has been mentioned before, oscillating tools according to the invention can be used in divers ways; they distinguish themselves by high flexibility. They are intended for multidirectional use, for example to be used horizontally on the floor, vertically on walls, overhead or obliquely in space. The user therefore can hold the hand-held tool in diverse gripping positions. In this connection, a longitudinal arrangement of the workspindle, the drive motor and the battery unit, along the longitudinal axis, has been found to be of advantage. The illustrated embodiment largely adheres to that arrangement although the center of gravity 40 of the battery unit 38 has been moved away from the longitudinal axis 42. This has the result to reduce vibrations that are generated by the oscillating drive. By giving the battery unit 38 an inclined arrangement relative to the longitudinal axis 42, shifted by the angles $\beta$ and $\gamma$, respectively, the housing 18 can be given a "smooth" transition from the drive motor 26 to the battery unit 38. Due to that embodiment, the user can continue to use the hand-held tool 10 multidirectionally, in the most diverse gripping positions.

What is claimed is:

1. A power-driven hand-held tool comprising:

a housing;

a drive motor arranged in said housing and having a motor shaft that defines a motor shaft axis;

a workspindle comprising a tool holding fixture arranged outside the housing for holding a tool, said workspindle defining a spindle axis arranged at a first angle relative to said motor shaft axis such that the spindle axis and motor shaft axis are not collinear;

at least one battery unit for supplying said drive motor with energy, said battery unit having a center of gravity;

wherein said drive motor drives said workspindle oscillatingly about said spindle axis;

wherein said center of gravity of said battery unit is located offset from said motor shaft axis on a side facing away from said tool holding fixture;

wherein said drive motor, when viewed in the direction of said motor shaft axis, is arranged between said workspindle and said battery unit; and wherein a plane is defined by said spindle axis and said motor shaft axis and bisected by said motor shaft axis into a first portion that intersects said tool holding fixture and a second portion that contains said center of gravity of said batter unit.

2. A power-driven hand-held tool comprising:

a housing;

a drive motor arranged in said housing and having a motor shaft that defines a motor shaft axis;

a workspindle comprising a tool holding fixture arranged outside the housing for holding a tool, said workspindle defining a spindle axis arranged at a first angle relative to said motor shaft axis such that the spindle axis and motor shaft axis are not collinear;

at least one battery unit for supplying said drive motor with energy, said battery unit having a center of gravity;

wherein said drive motor drives said workspindle oscillatingly about said spindle axis;

wherein said center of gravity of said battery unit is located offset from said motor shaft axis on a side facing away from said tool holding fixture;

wherein a plane is defined by said spindle axis and said motor shaft axis and bisected by said motor shalt axis into a first portion that intersects said tool holding fixture and a second portion that intersects said battery unit;

wherein said drive motor, when viewed in the direction of said motor shaft axis, is arranged between said workspindle and said battery unit; and wherein said battery unit comprises an end face pointing toward said workspindle, and further comprises an adjoining outer surface arranged at an angle thereto extending on a side of said motor shaft axis facing toward said tool, said outer surface comprising an at least partially flat portion, which partially flat portion and said motor shaft axis enclosing between them a second angle of between 5° and 60°.

3. The hand-held tool of claim 2, wherein said battery unit has a certain volume more than 50% of which are arranged on said side of said motor shaft axis facing away from said tool holding fixture.

4. The hand-held tool of claim 3, wherein said center of gravity of said battery unit is located in said second portion of said plane.

5. The hand-held tool of claim 4, wherein said battery unit is configured exchangeably.

6. The hand-held tool of claim 5, wherein said battery unit further comprises a covering surface adjoining said end face and extending at an angle thereto opposite said outer surface and having an at least partially flat portion, said at least partially flat portion of said covering surface and said motor shaft axis enclosing between them a third angle of between 5° and 60°.

7. The hand-held tool of claim 6, wherein said third angle is between 10° and 35°.

8. The hand-held tool of claim 1, wherein said center of gravity of said battery unit is located in said second portion of said plane.

9. The hand-held tool of claim 1, wherein said battery unit is configured exchangeably.

10. The hand-held tool of claim 1, wherein said battery unit further comprises a covering surface adjoining said end face and extending at an angle thereto opposite said outer surface and having an at least partially flat portion, said at least partially flat portion of said covering surface and said motor shaft axis enclosing between them a third angle of between 5° and 60°.

11. The hand-held tool of claim 10, wherein said third angle is between 10° and 35°.

12. A power-driven hand-held tool comprising:

a housing;

a drive motor arranged in said housing and having a motor shaft that defines a motor shaft axis;

a workspindle comprising a tool holding fixture arranged outside the housing for holding a tool, said workspindle defining a spindle axis arranged at a first angle relative to said motor shaft axis such that the spindle axis and motor shaft axis are not collinear;

at least one battery unit for supplying said drive motor with energy, said battery unit having a center of gravity;

wherein said drive motor drives said workspindle oscillatingly about said spindle axis;

wherein said center of gravity of said battery unit is located offset from said motor shaft axis on a side facing away from said tool holding fixture;

wherein a plane is defined by said spindle axis and said motor shaft axis and bisected by said motor shaft axis into a first portion that intersects said tool holding fixture and a second portion that intersects said battery unit.

13. The hand-held tool of claim 12, wherein said battery unit is configured exchangeably.

14. The hand-held tool of claim 12, wherein said drive motor, when viewed in the direction of said motor shaft axis, is arranged between said workspindle and said battery unit.

15. The hand-held tool of claim 12, wherein said battery unit comprises an end face pointing toward said workspindle, and further comprises an adjoining outer surface arranged at an angle thereto extending on a side of said motor shaft axis facing toward said tool, said outer surface comprising an at least partially flat portion, which partially flat portion and said motor shaft axis enclosing between them a second angle of between 5° and 60°.

16. The hand-held tool of claim 15, wherein said second angle is between 10° and 35°.

17. The hand-held tool of claim 15, wherein said battery unit further comprises a covering surface adjoining said end face and extending at an angle thereto opposite said outer surface and having an at least partially flat portion, said at least partially flat portion of said covering surface and said motor shaft axis enclosing between them a third angle of between 5° and 60°.

18. The hand-held tool of claim 17, wherein said third angle is between 10° and 35°.

19. The hand-held tool of claim 12, wherein said battery unit has a certain volume more than 50% of which are arranged on said side of said motor shaft axis facing away from said tool holding fixture.

20. The hand-held tool of claim 12, wherein said center of gravity of said battery unit is located in said second portion of said plane.

* * * * *